US009024960B2

(12) United States Patent
Hanamoto

(10) Patent No.: US 9,024,960 B2
(45) Date of Patent: May 5, 2015

(54) IMAGE DISPLAY APPARATUS AND CONTROL METHOD FOR CONTROLLING THE SAME

(75) Inventor: Nobuyuki Hanamoto, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 603 days.

(21) Appl. No.: 13/306,187

(22) Filed: Nov. 29, 2011

(65) Prior Publication Data

US 2012/0140145 A1 Jun. 7, 2012

(30) Foreign Application Priority Data

Dec. 6, 2010 (JP) ..... 2010-271700
Sep. 27, 2011 (JP) ..... 2011-210829

(51) Int. Cl.
*G09G 5/04* (2006.01)
*G09G 3/34* (2006.01)

(52) U.S. Cl.
CPC ..... *G09G 5/04* (2013.01); *G09G 3/3406* (2013.01); *G09G 2300/0443* (2013.01); *G09G 2320/0242* (2013.01); *G09G 2320/0276* (2013.01); *G09G 2340/0457* (2013.01); *G09G 2360/16* (2013.01); *G09G 2300/0478* (2013.01)

(58) Field of Classification Search
CPC ..... G09G 3/18; G09G 2360/16; G09G 2320/0626; G02B 5/3016; G02B 5/3025; G02B 5/3066
See application file for complete search history.

(56) References Cited

U.S. PATENT DOCUMENTS 7,843,529 B2 * 11/2010 Ikeno et al. ..... 349/81
8,184,221 B2 * 5/2012 Inoue et al. ..... 349/38
8,760,479 B2 * 6/2014 Shin et al. ..... 345/694

FOREIGN PATENT DOCUMENTS

JP 07-036054 2/1995
JP 2003-279924 10/2003

* cited by examiner

*Primary Examiner* — Antonio A Caschera
(74) *Attorney, Agent, or Firm* — Cowan, Liebowitz & Latman, P.C.

(57) ABSTRACT

An image display apparatus comprising pixels each one of which is composed of three subpixels, wherein each pair of the two subpixels is provided with a light source; a first polarizing filter which extracts a component of linearly polarized light from a light of the light source; a liquid crystal which rotates a polarization direction of the linearly polarized light; a polarizing filter which is provided corresponding to one of the subpixels and which extracts a polarized light component in a horizontal direction; a polarizing filter which is provided corresponding to the other of the subpixels and which extracts a polarized light component in a vertical direction; and a control unit which controls the output light amount of the light source and an angle of orientation of the liquid crystal.

10 Claims, 6 Drawing Sheets

IMAGE DISPLAY APPARATUS AND CONTROL METHOD FOR CONTROLLING THE SAME

BACKGROUND OF THE INVENTION

1. Field of the Invention

The present invention relates to an image display apparatus for displaying an image by using a panel module composed of a light source, a liquid crystal, and a polarizing filter, and a control method for controlling the same.

2. Description of the Related Art

When a high definition fixed pixel panel is realized, it is conceived that the number of pixels of the fixed pixel panel is simply increased. However, when the number of pixels is increased, then the number of liquid crystal elements is also increased to control the transmitted light transmitted through subpixels for constructing each of the pixels, and the numbers of electrodes, pixel driving circuits, and other components which are formed for the respective liquid crystal elements are also increased. Such a situation causes the decrease in the emission rate of each of the pixels (or the aperture ratio (numerical aperture) in relation to the liquid crystal panel). For this reason, there is a limit of the increase in the number of pixels while maintaining a predetermined emission rate in relation to any fixed pixel panel having a constant size. The smaller the liquid crystal display panel is, the more difficult to realize the high definition is.

In relation thereto, a technique is known as the conventional technique for realizing the high definition, wherein the optical axis of the light is shifted in a predetermined direction in accordance with the time sharing, and thus the number of pixels of an image display element is apparently doubled to effect the high resolution display.

Further, the following optical axis shift techniques, which use the liquid crystal elements, are known. That is, for example, JP7-36054A discloses a technique in which the optical axis is shifted such that the phase of the light is changed by a phase modulation optical element to deviate a polarization plane, and the incident light is selectively refracted by a double refraction medium. Further, JP2003-279924A discloses a technique in which the optical axis is shifted such that the direction of orientation of an optical path is selectively changed by a liquid crystal element.

SUMMARY OF THE INVENTION

When the number of pixels of the fixed pixel panel is simply increased in the fixed pixel panel, the conventional technique as described above involves such a problem that all of the pixels, which have the doubly increased number, are not simultaneously lighted or turned ON in displaying, therefore, the pixels are thinned out in displaying. In view of the above, the present invention provides an image display apparatus in which the number of pixels is doubled without increasing the number of liquid crystal elements and all of the pixels can be simultaneously lighted or turned ON.

According to a first aspect of the present invention, there is provided an image display apparatus comprising pixels each one of which is composed of a plurality of subpixels, wherein each pair of the two subpixels, which corresponds to each of liquid crystal elements, is provided with:

a light source unit which is capable of adjusting an output light amount;

a first polarizing unit which extracts a component of linearly polarized light from an output light of the light source unit;

a polarization direction rotating unit which rotates a polarization direction of the linearly polarized light extracted by the first polarizing unit in accordance with orientation angle control for the liquid crystal element;

a horizontal direction polarizing unit which is provided corresponding to one of the two subpixels and which extracts a light component having a horizontal polarization direction from the linearly polarized light having the polarization direction rotated by the polarization direction rotating unit; and a vertical direction polarizing unit which is provided corresponding to the other of the two subpixels and which extracts a light component having a vertical polarization direction from the linearly polarized light having the polarization direction rotated by the polarization direction rotating unit, the image display apparatus further comprising:

a control unit which acquires a target luminance value of each of the subpixels on the basis of an inputted image signal and which controls the output light amount of the light source unit and an angle of rotation of the polarization direction brought about by the polarization direction rotating unit so that a luminance value of each of the subpixels is the target luminance value.

According to a second aspect of the present invention, there is provided a control method for controlling an image display apparatus comprising pixels each one of which is composed of a plurality of subpixels; wherein each pair of the two subpixels, which corresponds to each of liquid crystal elements, is provided with a light source unit which is capable of adjusting an output light amount; a first polarizing unit which extracts a component of linearly polarized light from an output light of the light source unit; a polarization direction rotating unit which rotates a polarization direction of the linearly polarized light extracted by the first polarizing unit in accordance with orientation angle control for the liquid crystal element; a horizontal direction polarizing unit which is provided corresponding to one of the two subpixels and which extracts a light component having a horizontal polarization direction from the linearly polarized light having the polarization direction rotated by the polarization direction rotating unit; and a vertical direction polarizing unit which is provided corresponding to the other of the two subpixels and which extracts a light component having a vertical polarization direction from the linearly polarized light having the polarization direction rotated by the polarization direction rotating unit, the control method comprising:

a step of acquiring a target luminance value of each of the subpixels on the basis of an inputted image signal; and a step of controlling the output light amount of the light source unit and an angle of rotation of the polarization direction brought about by the polarization direction rotating unit so that a luminance value of each of the subpixels is the target luminance value.

According to the present invention, it is possible to provide the image display apparatus in which the number of pixels is doubled without increasing the number of liquid crystal elements and all of the pixels can be simultaneously lighted or turned ON.

Further features of the present invention will become apparent from the following description of exemplary embodiments with reference to the attached drawings.

DESCRIPTION OF THE EMBODIMENTS

First Embodiment

An image display apparatus according to a first embodiment of the present invention will be explained below.

Figure 1:
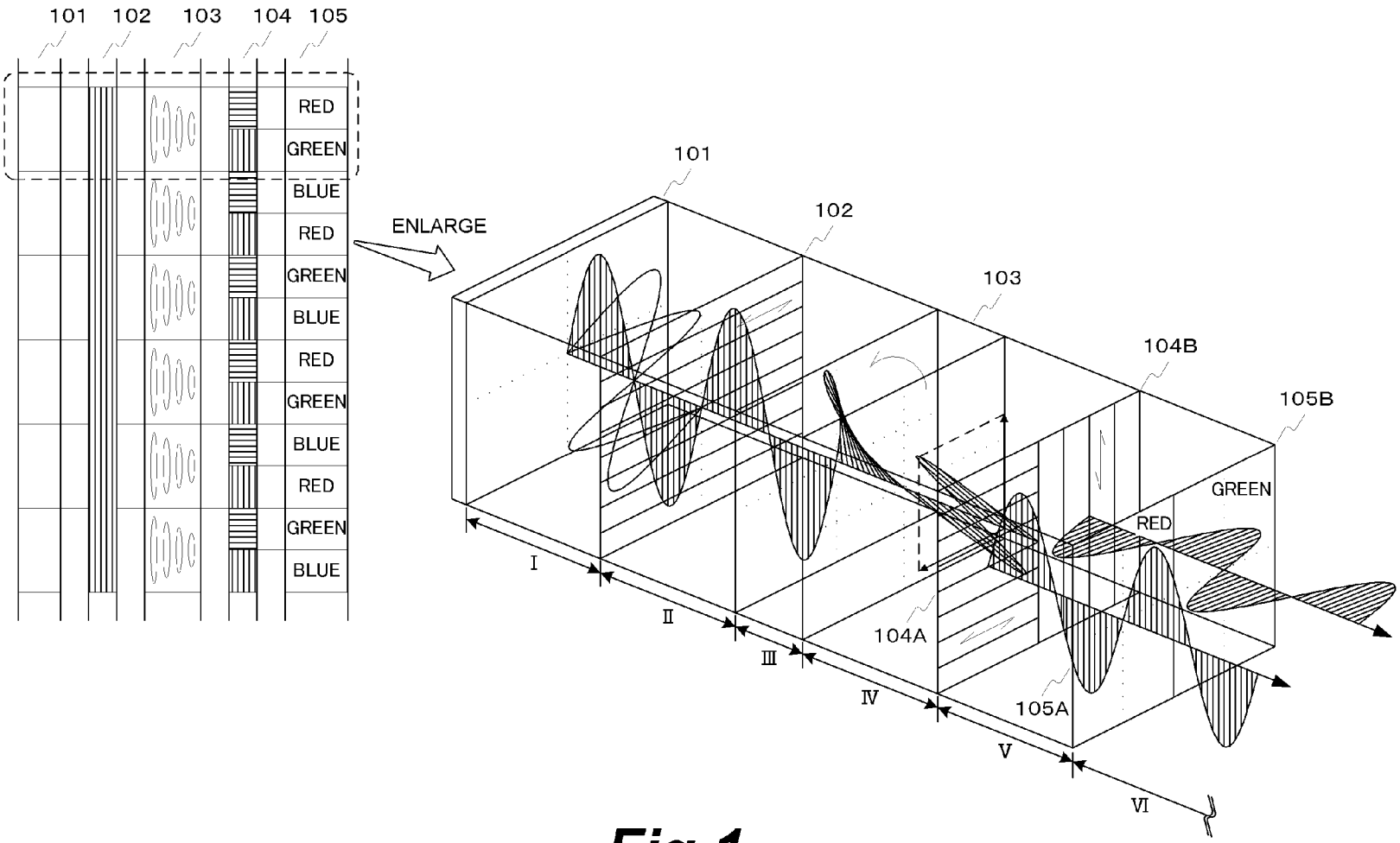
FIG. 1 shows a block diagram illustrating a structure of a panel module according to a first embodiment.

FIG. 1 shows a structure of a panel module 100 for realizing the image display apparatus according to the first embodiment. The panel module 100 comprises a light source 101, a first polarizing filter 102, a liquid crystal 103, a second polarizing filter 104, and a color filter 105.

In this image display apparatus, one pixel is composed of a plurality of subpixels. Specifically, one pixel is composed of three subpixels of R, G, and B. The light source 101 is a white light source in which the output is variable, and the light source 101 is arranged at a ratio of one with respect to every two subpixels for constructing the pixel. The first polarizing filter 102 is a polarizing filter (first polarizing unit) which is provided in order that the electric field of the horizontal direction component is absorbed with respect to the output light emitted from the light source and the component of the linearly polarized light in the vertical direction is obtained. The liquid crystal 103 (polarization direction rotating unit) plays such a role that the arrangement of liquid crystal molecules is twisted by applying the voltage and thus the polarization direction of the linearly polarized light is rotated, wherein the voltage control can be performed with respect to each one of liquid crystal elements as one unit for each pair of two subpixels while being in such a relationship that a pair is formed with the light source 101. A polarizing filter 104A (vertical direction polarizing unit) is provided corresponding to one of the two subpixels (red subpixel 105A), and the polarizing filter 104A is a polarizing filter which extracts a linearly polarized light having a vertical oscillation component from the linearly polarized light which is transmitted through the liquid crystal 103 and which has the rotated polarization direction. A polarizing filter 104B (horizontal direction polarizing unit) is provided corresponding to the other of the two subpixels (green subpixel 105B), and the polarizing filter 104B is a polarizing filter which extracts a linearly polarized light having a horizontal oscillation component from the linearly polarized light which is transmitted through the liquid crystal 103 and which has the rotated polarization direction. The second polarizing filter 104 is composed of the polarizing filter 104A and the polarizing filter 104B. The color filter 105 is an optical filter through which only the emission light of a color of each subpixel is transmitted.

Owing to the structure as described above, the output light from the light source 101 is provided as the non-polarized light as the white natural light in Period I, and the light is provided as the white linearly polarized light having the vertical oscillation component in Period II as a result of the passage through the first polarizing filter 102. In Period III, the oscillation direction of the white linearly polarized light is inclined (polarization direction is rotated) along the arrangement twist of the liquid crystal molecules of the liquid crystal 103. In Period IV, the light is provided as the white linearly polarized light which has the vertical oscillation component and the horizontal oscillation component. In Period V, the light, which is transmitted through the second polarizing filter 104A of the second polarizing filter 104 for absorbing the electric field of the horizontal direction component, becomes the white linearly polarized light having only the vertical oscillation component. Similarly, the light, which is transmitted through the second polarizing filter 104B for absorbing the electric field of the vertical direction component, becomes the white linearly polarized light having only the horizontal oscillation component. In Period VI, the white linearly polarized light, which has only the vertical oscillation component, is transmitted through the red transmission filter 105A, and thus the light becomes the red linearly polarized light. Further, the white linearly polarized light, which has the horizontal oscillation component, is transmitted through the green transmission filter 105B, and thus the light becomes the green linearly polarized light. The respective subpixels are lighted or turned ON by means of the linearly polarized lights as described above.

Figure 2:
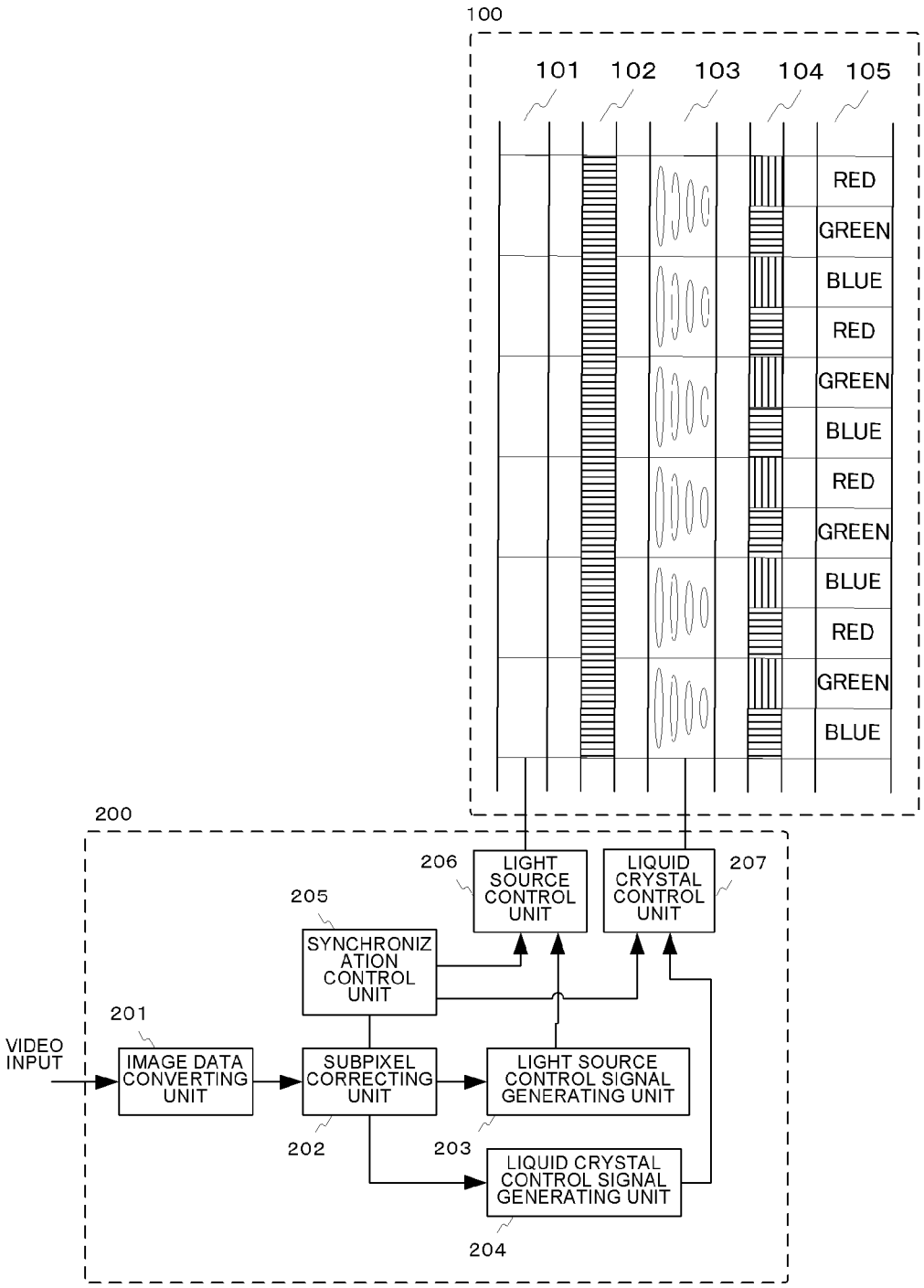
FIG. 2 shows a block diagram illustrating a structure of an image display processing unit of an image display apparatus according to the first embodiment.

Next, FIG. 2 shows a block diagram illustrating a structure of an image display processing unit 200 included in the image display apparatus for realizing the first embodiment.

As for the video signal (picture signal) inputted into the image display apparatus, the inputted image signal is converted by an image data converting unit 201 into digital values provided in subpixel units, and the digital values are outputted as a subpixel signal to a subpixel correcting unit 202. In the subpixel correcting unit 202, the two adjoining subpixels are firstly subjected to the pairing. Further, the compensation is made for the transmission loss of the light caused by the influence of the transmission characteristic of each of the color transmission filters of the color filter 105 and the transmission characteristic of the second polarizing filter 104 for absorbing electric field of the vertical or horizontal direction component in relation to each of the subpixels. For this purpose, the correction is performed in subpixel unit with respect to the subpixel signal, and the subpixel correction signal is generated. The signal is outputted to a light source control signal generating unit 203 and a liquid crystal control signal generating unit 204.

In the light source control signal generating unit 203, in order to determine the output value of the light source for turning ON the two subpixels subjected to the pairing on the basis of the subpixel correction signal, the vector composite value is calculated on the basis of the values of the two subpixels by using the trigonometric function. The light source control signal is generated, which is subjected to the correction in order to compensate the transmission loss of the light caused by the influence of the transmission characteristic of the liquid crystal 103 and the transmission characteristic of the linearly polarized light having only the vertical oscillation component concerning the first polarizing filter 102.

The signal is outputted to a light source control unit 206. In the liquid crystal control signal generating unit 204, the orientation angle of the liquid crystal (angle of rotation of the polarization direction brought about by the polarization direction rotating unit) is calculated by using the trigonometric function on the basis of the values of the two subpixels subjected to the pairing on the basis of the subpixel correction signal, and the liquid crystal control signal is generated. The signal is outputted to a liquid crystal control unit 207.

A synchronization control unit 205 performs the synchronization control for the light source control unit 206 and the liquid crystal control unit 207 so that the control is synchronized between the light source 101 and the liquid crystal 103. The light source control unit 206 performs the light emission control for the light source 101 on the basis of the light source control signal. The liquid crystal control unit 207 performs the orientation angle control for the liquid crystal 103 on the basis of the liquid crystal control signal.

Next, an explanation will be made about the flow of the process performed in the image display processing unit 200 by using a flow chart shown in FIG. 3.

In Step S301, the image data converting unit 201 converts the input video signal into the subpixel signal provided in subpixel unit, the target luminance value of each of the subpixels is acquired, and the routine proceeds to Step S302. In Step S302, the subpixel correcting unit 202 pairs the two mutually adjoining subpixels, and the routine proceeds to Step S303. In Step S303, the subpixel correcting unit 202 compensates the influence of the transmission characteristic of each color transmission filter of the color filter 105 and the transmission characteristic of the polarizing filter for absorbing the electric field of the vertical or horizontal direction component of the second polarizing filter 104 for each of the subpixels. That is, in order to compensate the light transmission loss in the filters as described above, the correction is performed in subpixel unit for the subpixel signal, the subpixel correction signal is generated, and the routine proceeds to Step S304 and Step S307.

In Step S304, the light source control signal generating unit 203 calculates the vector composite value on the basis of the values of the two subpixels by using the trigonometric function on the basis of the subpixel correction signal, and the routine proceeds to Step S305. In Step S305, the light source control signal generating unit 203 generates the light source control signal for which the correction is performed in order to compensate the light transmission loss caused by the influence of the transmission characteristic of the liquid crystal 103 and the transmission characteristic of the linearly polarized light having only the vertical oscillation component in relation to the first polarizing filter 102. Further, the routine proceeds to Step S306. In Step S306, the light source control unit 206 performs the light emission control for the light source 101 on the basis of the light source control signal, and the light source 101 emits the light. The light emission control is synchronized with the orientation angle control for the liquid crystal in Step S309. The routine returns to Step S301.

In Step S307, the liquid crystal control signal generating unit 204 calculates the orientation angle of the liquid crystal on the basis of the values of the two subpixels subjected to the pairing on the basis of the subpixel correction signal, and the routine proceeds to Step S308. In Step S308, the liquid crystal control signal generating unit 204 generates the liquid crystal control signal on the basis of the calculated orientation angle of the liquid crystal, and the routine proceeds to Step S309. In Step S309, the liquid crystal control unit 207 performs the orientation angle control for the liquid crystal 103 on the basis of the liquid crystal control signal, and the liquid crystal orientation angle of the liquid crystal 103 is changed. The orientation angle control is synchronized with the light emission control in Step S306. The routine returns to Step S301.

Next, an explanation will be made in detail about the conversion from the input video signal into the subpixel signal and the method for generating the subpixel correction signal, the light source control signal, and the liquid crystal control signal. A precondition is provided for the explanation such that the linearity of the light source control signal is coincident with the linearity of the light amount change of the light source 101. Further, it is assumed that the linearity of the liquid crystal control signal is coincident with the linearity of the orientation angle change of the liquid crystal. Further, it is assumed that there is no element of the transmission loss of the light in the panel module, except for the liquid crystal 103, the first polarizing filter 102, the second polarizing filter 104, and the color filter 105.

At first, the following relational expression of Expression 1 holds between the output values $R_{(x,y)}$, $G_{(x,y)}$, $B_{(x,y)}$ of the respective subpixels and the correction values $R'_{(x,y)}$, $G'_{(x,y)}$, $B'_{(x,y)}$ of the respective subpixels in which the transmission loss is compensated by the transmittance $\beta_v$, $\beta_h$ of the second polarizing filter 104 and the transmittance $\alpha_r$, $\alpha_g$, $\alpha_b$ of the color filter 105.

$$R'_{(x,y)} = \frac{R_{(x,y)}}{\alpha_r\beta_v},\ R'_{(x+1,y)} = \frac{R_{(x+1,y)}}{\alpha_r\beta_h}$$
$$G'_{(x,y)} = \frac{G_{(x,y)}}{\alpha_g\beta_v},\ G'_{(x+1,y)} = \frac{G_{(x+1,y)}}{\alpha_g\beta_h}$$
$$B'_{(x,y)} = \frac{B_{(x,y)}}{\alpha_b\beta_v},\ B'_{(x+1,y)} = \frac{B_{(x+1,y)}}{\alpha_b\beta_h} \quad \text{(Expression 1)}$$

$R_{(x,y)}$: value of red subpixel;
$G_{(x,y)}$: value of green subpixel;
$B_{(x,y)}$: value of blue subpixel;
$R'_{(x,y)}$: correction value of red subpixel;
$G'_{(x,y)}$: correction value of green subpixel;
$B'_{(x,y)}$: correction value of blue subpixel;
x: horizontal direction address of pixel (provided that x is odd number value);
y: vertical direction address of pixel;
$\alpha_r$: transmittance of red transmission filter 105A;
$\alpha_g$: transmittance of green transmission filter 105B;
$\alpha_b$: transmittance of blue transmission filter;
$\beta_v$: polarization transmittance of second polarizing filter 104A;
$\beta_h$: polarization transmittance of second polarizing filter 104B.

The following relational expression of Expression 2 holds between the correction values $R'_{(x,y)}$, $G'_{(x,y)}$, $B'_{(x,y)}$, $R'_{(x+1,y)}$, $G'_{(x+1,y)}$, $B'_{(x+1,y)}$ of the two subpixels subjected to the pairing and the vector composite value $e_{(x',y')}$ of the linearly polarized light having the vertical oscillation component and the linearly polarized light having the horizontal oscillation component.

$$e_{(x',y')} = \sqrt{R'^2_{(x,y)} + G'^2_{(x,y)}},\ \sqrt{B'^2_{(x,y)} + R'^2_{(x+1,y)}},\ \sqrt{G'^2_{(x+1,y)} + B'^2_{(x+1,y)}} \quad \text{(Expression 2)}$$

$e_{(x',y')}$: vector composite value of correction values of two subpixels;
x': horizontal direction address of light source;
y': vertical direction address of light source.

Further, the following relational expression of Expression 3 holds between the vector composite value $e_{(x',y')}$ and the value $E_{(x',y')}$ of the light source 101 in which the compensation is made for the transmission loss by the transmittance μ of the liquid crystal 103 and the transmittance γ of the linearly polarized light having only the vertical oscillation component in relation to the first polarizing filter 102.

$$E_{(x',y')} = \frac{e_{(x',y')}}{\mu\gamma} \quad \text{(Expression 3)}$$

$E_{(x',y')}$: output value of light source 101;

μ: transmittance of liquid crystal 103;

γ: transmittance of linearly polarized light having only vertical oscillation component of first polarizing filter 102.

Further, the following relational expression of Expression 4 holds between the correction values $R'_{(x,y)}$, $G'_{(x,y)}$, $B'_{(x,y)}$, $R'_{(x+1,y)}$, $G'_{(x+1,y)}$, $B'_{(x+1,y)}$ of the two subpixels subjected to the pairing and the orientation angle $\theta_{(x',y')}$ of the liquid crystal for splitting or dividing the output light from the light source 101 into those for the two subpixels.

$$\tan\theta_{(x',y')} = \frac{R'_{(x,y)}}{G'_{(x,y)}}, \frac{B'_{(x,y)}}{R'_{(x+1,y)}}, \frac{G'_{(x+1,y)}}{B'_{(x+1,y)}} \quad \text{(Expression 4)}$$

$\theta_{(x',y')}$: orientation angle of liquid crystal.

The relational expression to be applied is determined depending on the paring relation between the two subpixels. For example, when the red subpixel $R_{(1,1)}$ and the green subpixel $G_{(1,1)}$, which are adjacent to one another, are subjected to the light emission by means of one light source, the following relational expression holds as summarized according to Expressions 1 to 4.

$$E_{(1,1)} = \frac{\sqrt{\left(\frac{R_{(1,1)}}{\alpha_r\beta_v}\right)^2 + \left(\frac{G_{(1,1)}}{\alpha_g\beta_h}\right)^2}}{\mu\gamma}$$

$$\tan\theta_{(1,1)} = \frac{R_{(1,1)}}{\alpha_r\beta_v} \Big/ \frac{G_{(1,1)}}{\alpha_g\beta_h}$$

Figure 4:
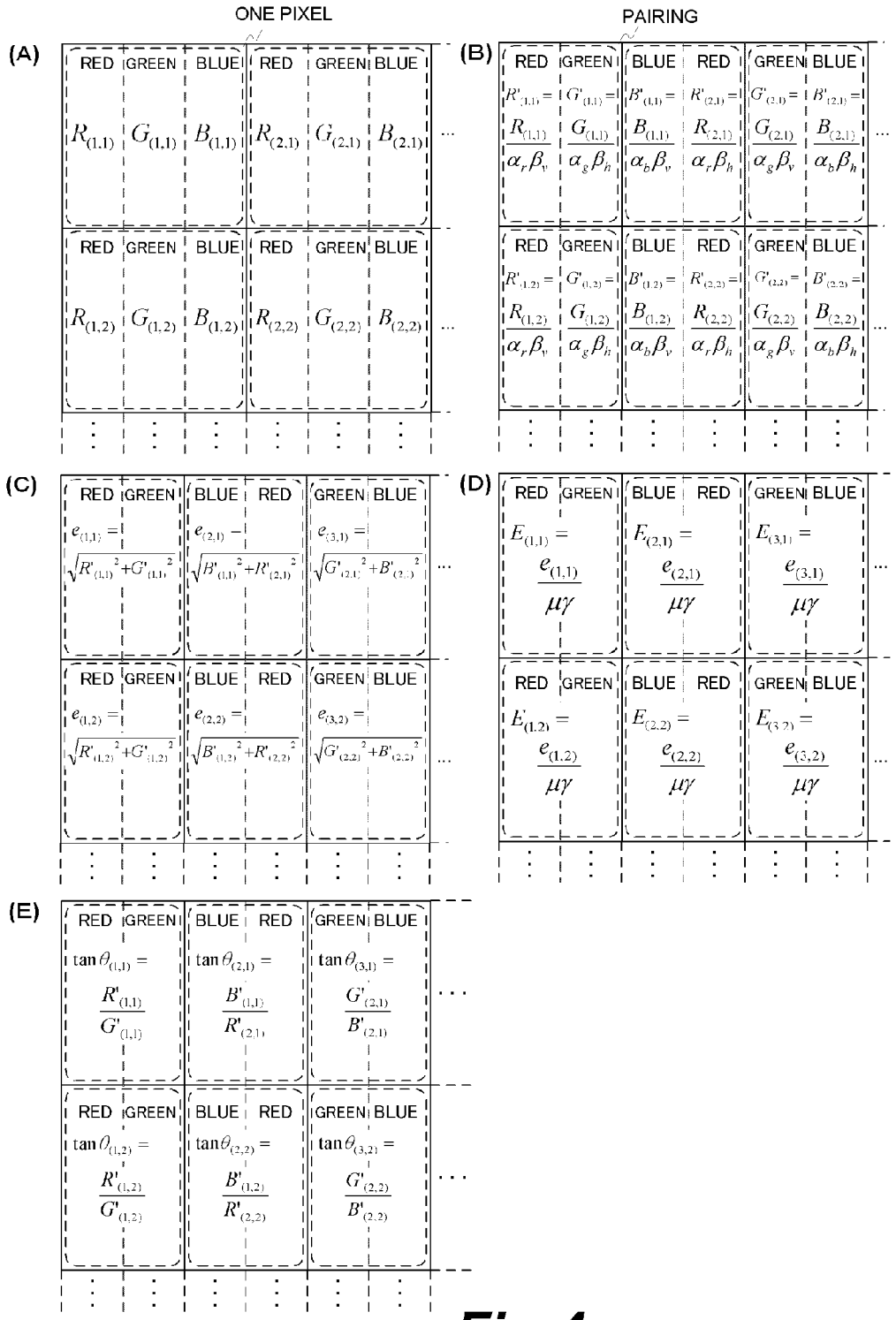
FIG. 4 shows the relationship among an input video signal (picture signal), a light source control signal, and a liquid crystal control signal according to the first embodiment.
Figure 5:
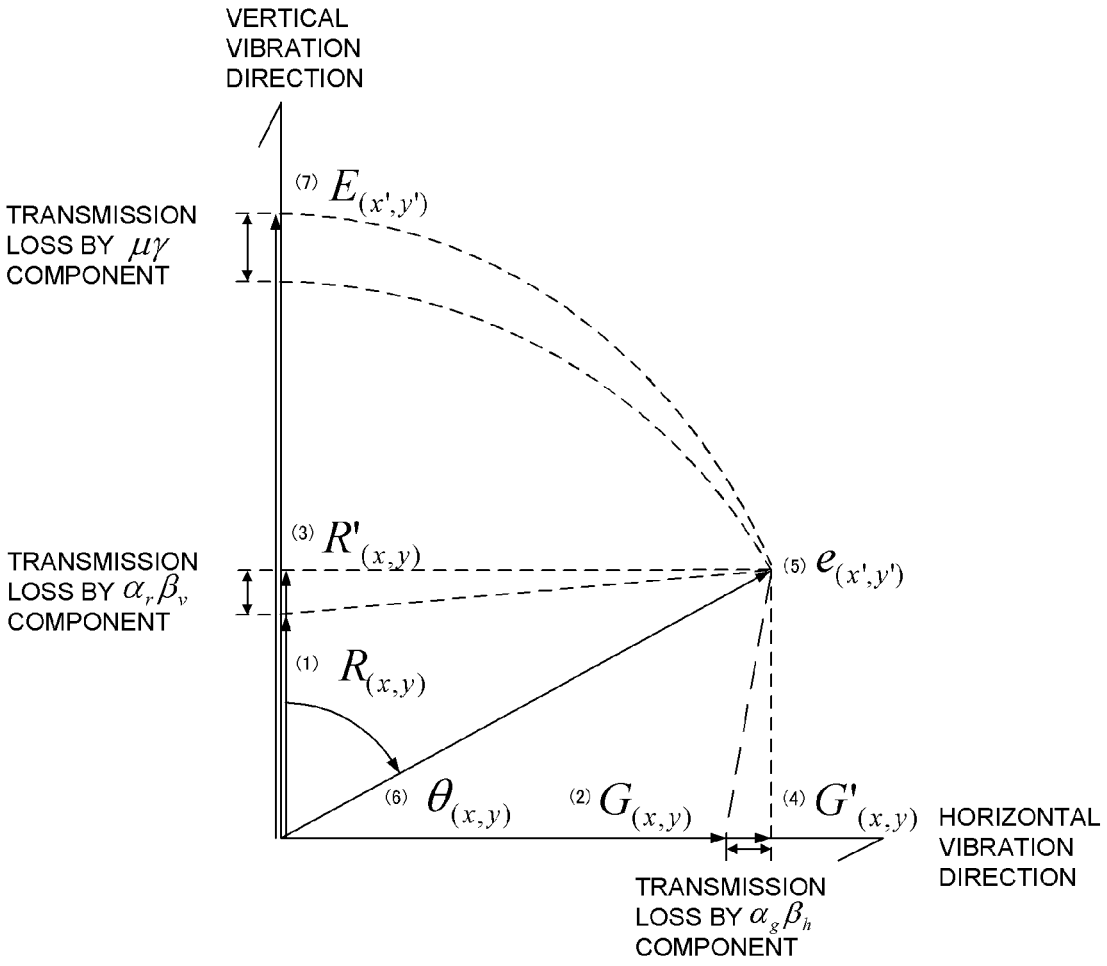
FIG. 5 shows the relationship among the input video signal (picture signal), the light source control signal, and the liquid crystal control signal according to the first embodiment.

Next, an explanation will be made about the relationship between the input video signal and the light source control signal and the liquid crystal control signal by using image diagrams shown in FIGS. 4 and 5. As for FIG. 5, an explanation will be made about an exemplary case in which the red subpixel $R_{(x,y)}$ and the green subpixel $G_{(x,y)}$ subjected to the pairing are allowed to undergo the light emission by means of one light source.

As for the input video signal, the subpixel signal is generated by the image data converting unit 201, and it is possible to illustrate the fact that each of the subpixels has the value of the subpixel as shown in FIG. 4A. In FIG. 5, the illustration can be depicted as represented by the red linearly polarized light $R_{(x,y)}$ having only the vertical oscillation component shown by (1) and the green linearly polarized light $G_{(x,y)}$ having only the horizontal oscillation component shown by (2).

The correction is performed for the subpixel signal by using Expression 1 by means of the subpixel correcting unit 202, and the subpixel correction signal is generated, wherein it is possible to illustrate the fact that each of the subpixels has the subpixel correction value as shown in FIG. 4B. In FIG. 5, the illustration can be depicted as represented by the red linearly polarized light correction value $R'_{(x,y)}$ shown by (3) and the green linearly polarized light correction value $G'_{(x,y)}$ shown by (4).

Further, the light source control signal generating unit 203 calculates the vector composite value $e_{(x',y')}$ from the correction values of the two subpixels subjected to the paring on the basis of Expression 2, on the basis of the subpixel correction signal. In this procedure, it is possible to illustrate the fact that each of the pairings of subpixels has the vector composite value as shown in FIG. 4C. In FIG. 5, the illustration can be depicted as represented by the vector composite value $e_{(x',y')}$ calculated by the vector combination based on (3) and (4). Further, the correction is performed in the light source control signal generating unit 203 for the vector composite value $e_{(x',y')}$ by using Expression 3, wherein the output value $E_{(x',y')}$ of the light source 101 is determined, and the light source control signal is generated. In this procedure, it is possible to illustrate the fact that each of the parings of subpixels has the output value of the light source 101 as shown in FIG. 4D. In FIG. 5, the restoration is effected by an amount of the orientation angle $\theta_{(x',y')}$ of (6) subjected to the inclination of the oscillation direction of the polarized light by the liquid crystal 103 with respect to (5). The illustration can be depicted as represented by the output value $E_{(x',y')}$ of the light source 101 of (7) in which the correction is performed for the transmission loss caused by the liquid crystal 103 and the transmission loss caused by the first polarizing filter 102.

Further, the liquid crystal control signal generating unit 204 calculates the orientation angle $\theta_{(x',y')}$ of the liquid crystal from the correction values of the two subpixels subjected to the paring on the basis of Expression 4, on the basis of the subpixel correction signal. In this procedure, it is possible to illustrate the fact that the relational expression as shown in FIG. 4E is provided for each of the parings of subpixels. In FIG. 5, the illustration can be depicted as represented by the orientation angle $\theta_{(x',y')}$ of (6).

Next, an explanation will be made about the control of the light source 101 and the liquid crystal 103 with respect to the actual input video signal as exemplified by a practical example. It is assumed that the number of gradations of each subpixel with respect to the input video signal is 8 bit [0 to 255], the number of gradations of the light source 101 is 10 bit [0 to 1023], and the number of gradations of the orientation angle of the liquid crystal is 10 bit [0 to 1023]. In order to perform the explanation more comprehensively, it is premised that the transmittances of $\alpha_r$, $\alpha_g$, $\alpha_b$, $\beta_v$, $\beta_h$, μ, γ are 100% (i.e., any transmission loss factor is absent). On this assumption, an explanation will be made about a case in which the red subpixel and the green subpixel subjected to the pairing are lighted or turned ON by controlling one light source 101 and the liquid crystal 103.

At first, the output level of the light source 101, which is required to provide the lighting output of the subpixel of 100% so that both of the subpixel values of the red and green subpixels are the maximum value [255], is set to provide the maximum value [1023] of the gradation control range. In this situation, the orientation angle $\theta_{(x',y')}$ of the liquid crystal is 45 degrees [511], and the light dividing ratio between the two subpixels is 1:1. When the subpixel values of the red and green subpixels are equal to one another, the orientation angle $\theta_{(x',y')}$ of the liquid crystal is 45 degrees. The output level of the light source 101 is changed depending on the target luminance values of the red and green subpixels.

Under the foregoing condition, when Expressions 1 to 3 are further arranged while taking the gradation bit conversion into consideration, it is possible to derive the following conversion expression of Expression 5.

$$E_{(x',y')} = 1023 \times \frac{\sqrt{R^2_{(x,y)} + G^2_{(x,y)}}}{\sqrt{255^2 + 255^2}}, \quad 1023 \times \frac{\sqrt{B'^2_{(x,y)} + R'^2_{(x+1,y)}}}{\sqrt{255^2 + 255^2}}, \quad 1023 \times \frac{\sqrt{G'^2_{(x+1,y)} + B'^2_{(x+1,y)}}}{\sqrt{255^2 + 255^2}} \tag{Expression 5}$$

Accordingly, for example, the consideration is made about the output of the light emission output of 57.7% [147] of the red subpixel and the light emission output of 100% [255] of the green subpixel. In this case, the calculation can be performed such that the output value $E_{(x',y')}$, at which the output level of the light source 101 is 81.7%, is [835] according to Expression 5, and the orientation angle $\theta_{(x',y')}$ of the liquid crystal is about 60 degrees [682] according to Expression 4. When the light emission output of the red subpixel is 0% [0], and the light emission output of the green subpixel is 100% [255], then the calculation can be performed such that the output value $E_{(x',y')}$, at which the output level of the light source 101 is 70.7%, is [723] according to Expression 5, and the orientation angle $\theta_{(x',y')}$ of the liquid crystal is about 90 degrees [1023] according to Expression 4. Further, when the light emission output of the red subpixel is 100% [255], and the light emission output of the green subpixel is 0% [0], then the calculation can be performed such that the output value $E_{(x',y')}$, at which the output level of the light source 101 is 70.7%, is [723] according to Expression 5, and the orientation angle $\theta_{(x',y')}$ of the liquid crystal is about 0 degree [0] according to Expression 4.

Accordingly, the output light coming from one light source is divided at any arbitrary ratio by using the liquid crystal element by employing the polarizing filter and the orientation means in order to change the oscillation direction of the linearly polarized light without shifting the optical axis of the light source, and thus the two mutually adjoining subpixels are lighted or turned ON by means of one light source. Accordingly, the number of pixels can be doubled without increasing the number of liquid crystal elements, and all of the pixels can be simultaneously lighted or turned ON to realize the progressive display.

The light source 101 is the unit corresponding to one liquid crystal element for constructing the liquid crystal 103 (corresponding to each of the pairs of two subpixels), for which it is allowable to use any one capable of controlling the output level. For example, the following arrangements (1) and (2) are exemplified.

(1) Arrangement in which the liquid crystal is interposed between the polarizing element in the vertical direction and the polarizing element in the horizontal direction, and the transmittance of the light is changed by performing the orientation angle control in the liquid crystal element unit for constructing the liquid crystal 103 with respect to the light coming from the light-emitting element such as white LED (light emitting diode) or the like.

(2) Arrangement in which the self-light emission type organic EL (Electro Luminescence) technique is used, and one organic EL element is arranged corresponding to one liquid crystal element for constructing the liquid crystal 103 so that the output level of the white light is controlled in the organic EL element unit.

Second Embodiment

A second embodiment of the present invention will be explained below.

In the control method for controlling the liquid crystal 103 in the first embodiment, when the values of the two subpixels subjected to the pairing are [0] (when both of the target luminance values are zero), the orientation angle $\theta_{(x',y')}$ is 90 degrees. In this situation, the light dividing ratio, which is brought about by the liquid crystal 103, is 100% on the side of the subpixel on which the second polarizing filter 104B for absorbing the electric field of the vertical direction component is provided. If the light source 101 is ideal, the output value of the light source 101 is 0. Therefore, the subpixel is not lighted or turned ON irrelevant to the deviation of the light dividing ratio. However, when the output light amount cannot be 0 due to the characteristic of the light source 101 to be used, the faint light, which is outputted from the light source 101, leaks from only the side of the subpixel on which the second polarizing filter 104B for absorbing the electric field of the vertical direction component is provided. As a result, only the side of the subpixel, on which the second polarizing filter 104B for absorbing the electric field of the vertical direction component is provided, is faintly lighted or turned ON. As a result, the color emission of the pixel for the black display is deviated toward the color of any specified subpixel.

In view of the above, in the second embodiment, a process is added to the first embodiment, in which the orientation angle $\theta_{(x',y')}$ of the liquid crystal 103 corresponding to the concerning pair of two subpixels is controlled to be 45 degrees, if the values of the two subpixels subjected to the pairing are [0].

Figure 3:
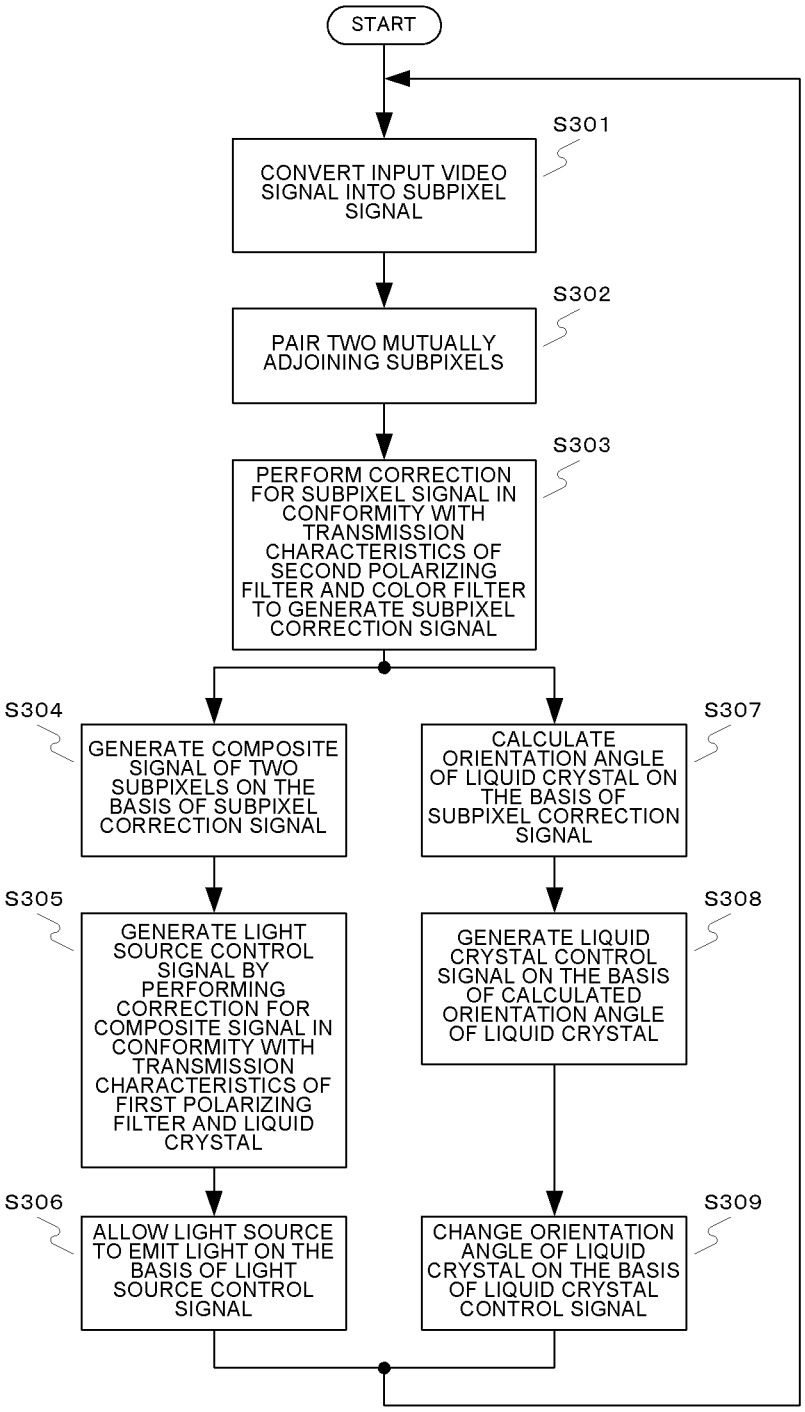
FIG. 3 shows a flow chart illustrating the image display control operation of the image display apparatus according to the first embodiment.
Figure 6:
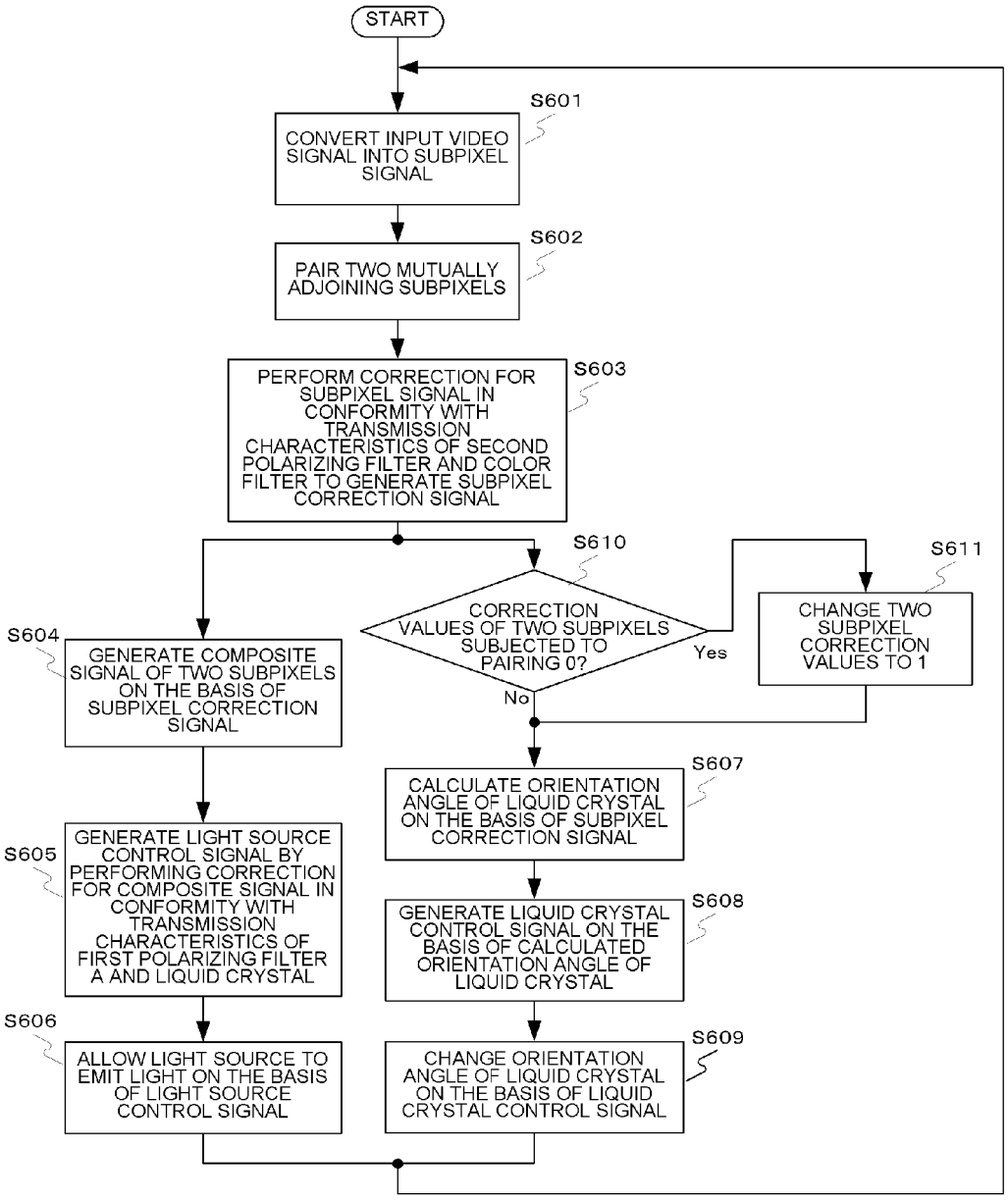
FIG. 6 shows a flow chart illustrating the image display control operation of an image display apparatus according to a second embodiment.

In order to realize this process, as illustrated in a flow chart shown in FIG. 6, processes of Step S610 and Step S611 are added to the processes of the flow chart shown in FIG. 3 in the first embodiment. Processes of Steps S601, S602, S603, S604, S605, S606, S607, S608, and S609 are common to the processes of Steps S301, S302, S303, S304, S305, S306, S307, S308, and S309 in the first embodiment, respectively, an explanation of which will be omitted.

In Step S610, it is judged whether or not the correction values of the two subpixels subjected to the paring in the subpixel correcting unit 202 are [0], in relation to the subpixel correction signal generated in Step S603. If both of the values are [0], the routine proceeds to Step S611. If any one of the values is not [0], the routine proceeds to Step S607. In Step S611, in order that the orientation angle $\theta_{(x',y')}$ of the liquid crystal is 45 degrees, the correction values of the two subpixels subjected to the pairing are changed to [1]. The routine proceeds to Step S607.

Accordingly, it is possible to further avoid such an inconvenience that the color is emitted and the lighting is turned ON while being deviated toward one subpixel color due to the faint light outputted from the light source 101 when the values of subpixels subjected to the pairing are [0], as compared with the first embodiment.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-271700, filed on Dec. 6, 2010, and Japanese Patent Application No. 2011-210829, filed on Sep. 27, 2011, which are hereby incorporated by reference herein in their entirety.

What is claimed is:

1. An image display apparatus comprising pixels each one of which is composed of a plurality of subpixels, wherein each pair of the plurality of subpixels, which corresponds to each of liquid crystal elements, is provided with:

a light source unit which is capable of adjusting an output light amount;

a first polarizing unit which extracts a component of linearly polarized light from an output light of the light source unit;

a polarization direction rotating unit which rotates a polarization direction, by an angle of rotation determined by a control unit, of the linearly polarized light extracted by the first polarizing unit in accordance with orientation angle control for the liquid crystal element;

a horizontal direction polarizing unit which is provided corresponding to one of the pair of the plurality of subpixels and which extracts a light component having a horizontal polarization direction from the linearly polarized light having the polarization direction rotated by the polarization direction rotating unit; and a vertical direction polarizing unit which is provided corresponding to the other of the pair of the plurality of subpixels and which extracts a light component having a vertical polarization direction from the linearly polarized light having the polarization direction rotated by the polarization direction rotating unit, the image display apparatus further comprising:

the control unit which acquires a target luminance value of each of the subpixels on the basis of an inputted image signal and which controls the output light amount of the light source unit and the angle of rotation of the polarization direction brought about by the polarization direction rotating unit so that a luminance value of each of the subpixels is the target luminance value.

2. The image display apparatus according to claim 1, wherein the control unit controls the angle of rotation of the polarization direction brought about by the polarization direction rotating unit so that the polarization direction of the linearly polarized light transmitted through the polarization direction rotating unit corresponding to the pair is 45 degrees with respect to a horizontal direction if the target luminance values of the pair are equal to one another.

3. The image display apparatus according to claim 1, wherein the control unit controls the angle of rotation of the polarization direction brought about by the polarization direction rotating unit so that the polarization direction of the linearly polarized light transmitted through the polarization direction rotating unit corresponding to the pair is 0 degree or 90 degrees with respect to a horizontal direction if one of the target luminance values of the pair is zero.

4. The image display apparatus according to claim 1, wherein the control unit controls the angle of rotation of the polarization direction brought about by the polarization direction rotating unit so that the polarization direction of the linearly polarized light transmitted through the polarization direction rotating unit corresponding to the pair is 45 degrees with respect to a horizontal direction if both of the target luminance values of the pair are zero.

5. The image display apparatus according to claim 1, wherein:

one pixel is composed of the red, green, and blue subpixels; and the pair of the plurality of subpixels is a pair of the subpixels of the different colors.

6. A control method for controlling an image display apparatus comprising pixels each one of which is composed of a plurality of subpixels; wherein each pair of the plurality of subpixels, which corresponds to each of liquid crystal elements, is provided with a light source unit which is capable of adjusting an output light amount; a first polarizing unit which extracts a component of linearly polarized light from an output light of the light source unit; a polarization direction rotating unit which rotates a polarization direction, by an angle of rotation determined in a control step, of the linearly polarized light extracted by the first polarizing unit in accordance with orientation angle control for the liquid crystal element; a horizontal direction polarizing unit which is provided corresponding to one of the pair of the plurality of subpixels and which extracts a light component having a horizontal polarization direction from the linearly polarized light having the polarization direction rotated by the polarization direction rotating unit; and a vertical direction polarizing unit which is provided corresponding to the other of the pair of the plurality of subpixels and which extracts a light component having a vertical polarization direction from the linearly polarized light having the polarization direction rotated by the polarization direction rotating unit, the control method comprising:

an acquiring step of acquiring a target luminance value of each of the subpixels on the basis of an inputted image signal; and the control step of controlling the output light amount of the light source unit and the angle of rotation of the polarization direction brought about by the polarization direction rotating unit so that a luminance value of each of the subpixels is the target luminance value.

7. The control method for controlling the image display apparatus according to claim 6, wherein the angle of rotation of the polarization direction brought about by the polarization direction rotating unit is controlled in the control step so that the polarization direction of the linearly polarized light transmitted through the polarization direction rotating unit corresponding to the pair is 45 degrees with respect to a horizontal direction if the target luminance values of the pair are equal to one another.

8. The control method for controlling the image display apparatus according to claim 6, wherein the angle of rotation of the polarization direction brought about by the polarization direction rotating unit is controlled in the control step so that the polarization direction of the linearly polarized light transmitted through the polarization direction rotating unit corresponding to the pair is 0 degree or 90 degrees with respect to a horizontal direction if one of the target luminance values of the pair is zero.

9. The control method for controlling the image display apparatus according to claim 6, wherein the angle of rotation of the polarization direction brought about by the polarization direction rotating unit is controlled in the control step so that the polarization direction of the linearly polarized light transmitted through the polarization direction rotating unit corresponding to the pair is 45 degrees with respect to a horizontal direction if both of the target luminance values of the pair are zero.

10. The control method for controlling the image display apparatus according to claim 6, wherein:

one pixel is composed of the red, green, and blue subpixels; and the pair of the subpixels is a pair of the subpixels of the different colors.

* * * * *